US011512421B2

(12) United States Patent
Erickson et al.

(10) Patent No.: US 11,512,421 B2
(45) **Date of Patent: *Nov. 29, 2022**

(54) LAUNDRY TREATING APPLIANCE

(71) Applicant: WHIRLPOOL CORPORATION, Benton Harbor, MI (US)

(72) Inventors: Donald Erickson, Stevensville, MI (US); Steven Fricke, St. Joseph, MI (US); Christian Gianni, Stevensville, MI (US); Thomas Kessler, Stevensvill, MI (US); Praveen Poojary, St. Joseph, MI (US); Erica Roberts, Stevensville, MI (US); Jaime Rodriguez, Benton Harbor, MI (US); Peter Wagoner, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 29 days.

This patent is subject to a terminal disclaimer.

(21) Appl. No.: 17/130,186

(22) Filed: Dec. 22, 2020

(65) Prior Publication Data

US 2021/0108352 A1 Apr. 15, 2021

Related U.S. Application Data

(63) Continuation of application No. 15/872,033, filed on Jan. 16, 2018, now Pat. No. 10,907,290.

(60) Provisional application No. 62/447,029, filed on Jan. 17, 2017.

(51) Int. Cl.
*D06F 37/10* (2006.01)
*D06F 37/04* (2006.01)

(52) U.S. Cl.
CPC ..... *D06F 37/10* (2013.01); *D06F 37/04* (2013.01)

(58) Field of Classification Search
CPC ..... D06F 37/02; D06F 37/04; D06F 37/10; D06F 37/12; D06F 37/18; D06F 21/02; D06F 21/04; D06F 21/06; D06F 21/08; D06F 21/10; D06F 23/02; D06F 23/04; D06F 23/06; D06F 25/00; D06F 15/02; D06F 58/02; D06F 58/04
See application file for complete search history.

(56) References Cited

U.S. PATENT DOCUMENTS

| | | | |
|---|---|---|---|
| 1,396,456 | A | 11/1921 | Mueller |
| 2,392,034 | A | 1/1946 | Ellis et al. |
| 3,280,983 | A | 10/1966 | Morena |
| 5,375,439 | A | 12/1994 | Nehren et al. |

(Continued)

FOREIGN PATENT DOCUMENTS

| | | | |
|---|---|---|---|
| EP | 0694645 | A1 | 1/1996 |
| EP | 2316998 | A1 | 5/2011 |

(Continued)

OTHER PUBLICATIONS

European Search Report for Counterpart EP18152184.0, dated Jun. 14, 2018.

*Primary Examiner* — David G Cormier
(74) *Attorney, Agent, or Firm* — McGarry Bair PC

(57) ABSTRACT

A laundry treating appliance, such as a washing machine, having a cabinet defining an interior and defining an access opening. A lid can be movably mounted relative to the cabinet to selectively open or close the access opening. A tub can be located within the interior and the tub can contain a rotatably mounted drum, such as a horizontally rotatable drum, including a flexible fabric material.

22 Claims, 4 Drawing Sheets

(56) References Cited

U.S. PATENT DOCUMENTS

| | | | |
|---|---|---|---|
| 5,678,430 | A | 10/1997 | Merlin et al. |
| 6,233,981 | B1 | 5/2001 | Grandpierre |
| 6,588,238 | B1 | 7/2003 | Reason |
| 2012/0284931 | A1 | 11/2012 | Jenkins et al. |

FOREIGN PATENT DOCUMENTS

| | | | |
|---|---|---|---|
| EP | 2650424 | A1 | 10/2013 |
| EP | 2871276 | A1 | 5/2015 |
| GB | 742264 | A | 12/1955 |
| JP | 2005205194 | A | 8/2005 |
| WO | 0014322 | A1 | 3/2000 |
| WO | 2011064581 | A1 | 6/2011 |

LAUNDRY TREATING APPLIANCE

CROSS-REFERENCE TO RELATED APPLICATION(S)

This application is a continuation application of U.S. patent application Ser. No. 15/872,033, filed Jan. 16, 2018, now U.S. Pat. No. 10,907,290, issued Feb. 2, 2021, which claims priority to U.S. Provisional Patent Application No. 62/447,029, filed Jan. 17, 2017, both of which are incorporated herein by reference in their entirety.

BACKGROUND

Conventional top-loading horizontal axis laundry treating appliances, such as washing machines, have a tub with an access opening and a rotatable drum disposed within the tub. The access opening allows laundry to be loaded through the peripheral wall of the drum. Typically, this opening is covered during operation of the appliance with hinged or sliding doors. The parts for the doors need to combat various stresses associated with operating the appliances.

As users desire laundry treating appliances with improved performance and larger capacities to hold more laundry per load and improved energy efficiency, machines are required to have larger drums and greater spin speeds than in the past. As drum capacity and spin speeds increase, the stresses on the doors and opening increase, and tolerance requirements become more stringent. This, in turn, increases cost and complexity to create suitable mechanical structures for doors for rotatable drums. Configuring a door with increased complexity that is nonetheless user-friendly, can introduce additional challenges that further increase the cost of manufacture.

BRIEF SUMMARY

One aspect of the present disclosure relates to a laundry treating appliance for treating a load of laundry according to a cycle of operation. The laundry treating appliance comprises a cabinet defining an interior, a tub, housed within the interior, and a drum at least partially received within the tub. The drum has a sidewall and a pair of end walls and defines a circumference of the drum and at least partially defines a treating chamber. The drum has an opening disposed within the sidewall and the drum is configured to selectively rotate within the tub. The sidewall comprises a shell that defines an exterior surface with the drum opening located in the shell. The laundry treating appliance also has a moveable door operably coupled to the shell and moveable between an opened position where access is provided to the treating chamber through the drum opening and a closed position. The laundry treating appliance also has a flexible fabric material operably coupled at a first end to a portion of the drum and is configured to be wrapped, under tension, to cover the circumference of the sidewall including the drum opening.

Another aspect of the present disclosure relates to a laundry treating appliance for treating a load of laundry according to a cycle of operation. the laundry treating appliance has a cabinet defining an interior; a tub, housed within the interior and a drum at least partially received within the tub. The drum has a sidewall that defines a circumference of the drum and at least partially defines a treating chamber. A drum opening is disposed within the sidewall and the drum is configured to selectively rotate within the tub. The sidewall comprises a shell defining an exterior surface with the drum opening located in the shell. The laundry treating appliance also has a flexible fabric material operably coupled at a first end to a portion of the drum and configured to move between an unwrapped position and a wrapped position. At least a length of the flexible fabric material is configured to be wound about an entire circumference of the drum and overlap to provide at least two layers of the flexible fabric material across the drum opening in the wrapped position.

Another aspect of the present disclosure relates to a laundry treating appliance for treating a load of laundry according to a cycle of operation. the laundry treating appliance has a cabinet defining an interior; a tub, housed within the interior and a drum at least partially received within the tub. The drum has a sidewall that defines a circumference of the drum and at least partially defines a treating chamber. A drum opening is disposed within the sidewall and the drum is configured to selectively rotate within the tub. The sidewall comprises a shell defining an exterior surface with the drum opening located in the shell. The laundry treating appliance also has a flexible fabric material operably coupled at a first end to a portion of the drum and configured to move between an unwrapped position and a wrapped position wherein at least a length of the flexible fabric material is configured to be wound about an entire circumference of the drum and a take-up device comprising a spring-loaded mechanism, the take-up device configured to take up the flexible fabric material from the drum as it moves from the wrapped position to the unwrapped position.

DETAILED DESCRIPTION

Figure 1:
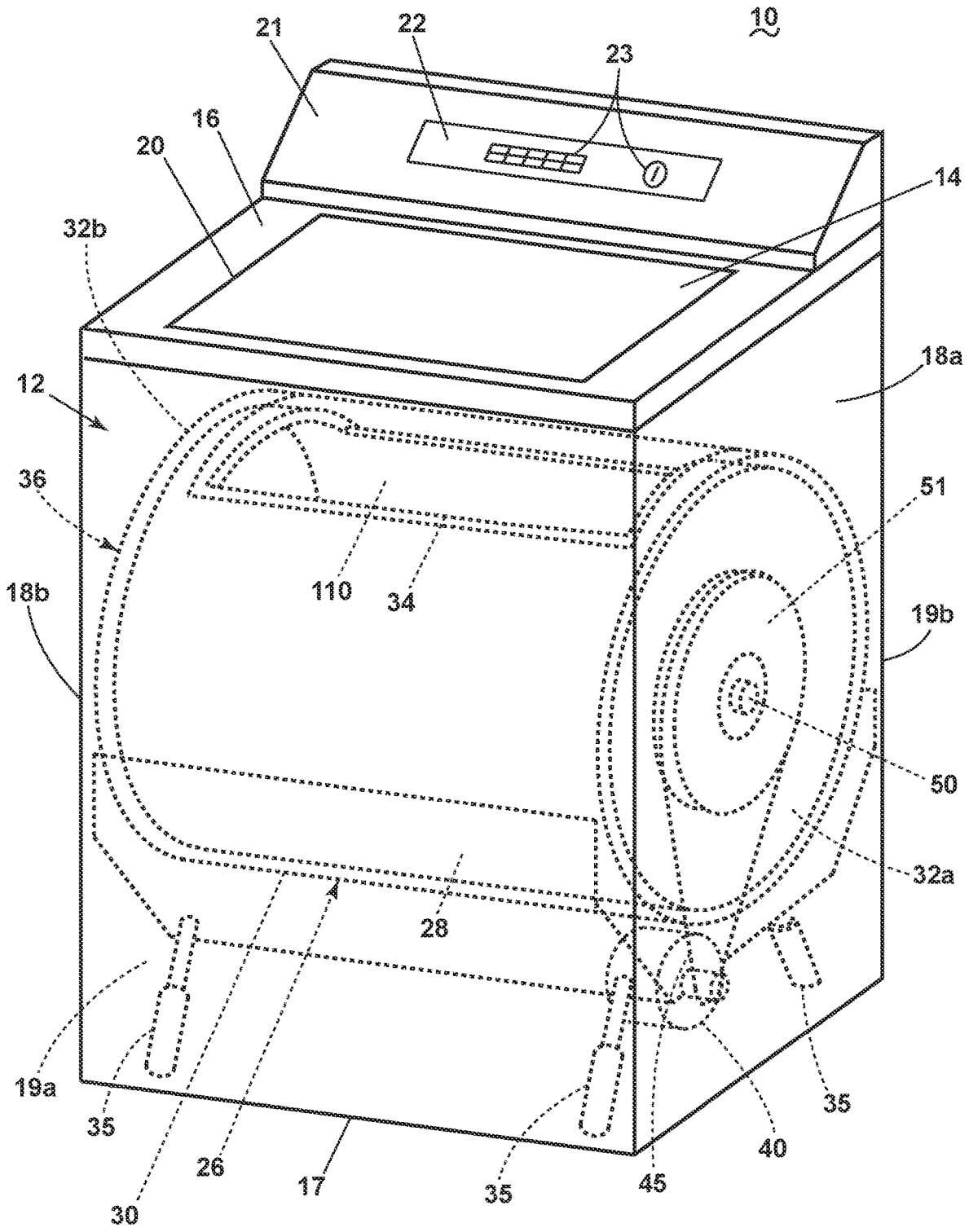
FIG. 1 is a schematic view of a laundry treating appliance in the form of a top-loading, horizontal axis washing machine.

Aspects of the present disclosure relate to using a flexible fabric material to cover the drum opening during operation. This is an efficient, cost-effective, durable, reliable, and user-friendly alternative to the hinged or sliding door systems used on conventional drums. FIG. 1 is a schematic view of a laundry treating appliance in the form of a top-loading horizontal axis washing machine 10 in accordance with aspects of the present disclosure. Although much of the remainder of this application will focus on the top-loading horizontal axis washing machine 10, the present disclosure encompasses other environments, including other laundry treating appliances including other horizontal axis laundry treating appliances. The laundry treating appliance can be any appliance which performs a cycle of operation to clean or otherwise treat items placed therein, non-limiting examples of which include a laundry dryer, a combination washing machine and dryer, a dispensing dryer, a tumbling refreshing/revitalizing machine, an extractor, a non-aqueous washing apparatus, and a revitalizing machine.

For purposes of this description, the terms horizontal axis and vertical axis are used to represent the general orientation of the axis of rotation and is not meant to be limited to a perfectly horizontal or vertical axis of rotation. More accurately, the terms horizontal axis of rotation or vertical axis of rotation, when used to identify the type of laundry treating appliance, are more accurately used to describe the primary mechanism by which mechanical energy is imparted to the laundry. The horizontal axis washing machine imparts mechanical energy primarily by tumbling the laundry within the drum. That is, rotation of the drum lifts and then drops the laundry. This lifting/dropping imparts mechanical energy to the laundry. The vertical axis washing machine imparts mechanical energy via a clothes mover, such as an agitator, impeller, pulsator, auger, etc., which is rotated within the basket to effect movement of liquid in the basket or directly impact the laundry. While a laundry container is normally referred to as a drum for a horizontal axis machine and a basket for a vertical axis machine, for this disclosure, unless otherwise stated, drum and basket are interchangeable.

The laundry treating appliance of FIG. 1 is a top-loading, horizontal axis washing machine 10, which can include a cabinet 12 for housing operational parts of the machine, together with a lid 14. The cabinet 12 can be a housing having a chassis and/or a frame, defining an interior enclosing components typically found in a conventional washing machine, such as motors, pumps, fluid lines, controls, sensors, transducers, and the like. Such components will not be described further herein except as necessary for a complete understanding of aspects of the present disclosure. The cabinet 12 can have a top panel 16, a bottom panel 17, a front panel 19*a*, a rear panel 19*b*, a first side panel 18*a*, and a second side panel 18*b*.

An access opening 20 is disposed in the top panel 16. The lid 14 can be any suitable lid including a slidable or hinged lid. In the illustrated example, the lid 14 is shown as hinged lid that is pivotally attached to the cabinet 12. The lid 14 can be movable between an opened and closed position to allow access to the access opening 20.

A console 21 having a control system 22, which can be operably coupled to operating controls 23 for the washer is illustrated. It will be understood that the operating controls 23 can include one or more knobs, dials, switches, displays, touch screens, and the like for communicating with the user, such as to receive input and provide output. The user can enter different types of information including, without limitation, cycle selection, and cycle parameters, such as cycle options. The control system 22 can be operably coupled to the operating controls and can control the operation of the washing machine 10 to implement one or more cycles of operation. The control system 22 can include a controller provided with, among other things, a memory and a central processing unit (CPU). The memory may be used for storing the control software that may be executed by the CPU in completing a cycle of operation using the appliance and any additional software. The memory may also be used to store information, such as a database or table, and to store data received from the one or more components of the appliance that may be communicably coupled with the control system 22.

A wash tub or tub 26 and a basket or drum 28 can be located within the cabinet 12. The tub 26 is cylindrical and has a side wall 30, a first end wall 32*a*, and a second end wall 32*b*. The tub 26 is situated within the cabinet 12 such that the first and second end walls 32*a*, 32*b* are parallel with the first and second side panels, 18*a* and 18*b* respectively, of the cabinet 12. An opening 34 is disposed in a top portion of the side wall 30 of the tub 26. The opening 34 is aligned with the access opening 20 and can be accessed through the access opening 20 when the lid 14 is in the opened position. The tub 26 can be supported within the cabinet 12 by a suitable suspension system 35.

The drum 28 is rotatably mounted within an interior of the tub 26 and defines a treating chamber 36 in which laundry can be held during operation of the washing machine 10. The washing machine 10 also includes a drive system for rotating the drum 28 within the tub 26. The drive system can include a motor 40 for rotationally driving the drum 28. The motor 40 can be directly coupled with the drum 28 through a drive shaft 50 to rotate the drum 28 about a rotational axis during an automatic cycle of operation. The motor 40 can be a brushless permanent magnet (BPM) motor. Alternately, the motor 40 can be coupled with the drum 28 through a belt 45 and a pulley 51 mounted to a drive shaft 50 to rotate the drum 28, as is known in the art. Other motors, such as an induction motor or a permanent split capacitor (PSC) motor, can also be used. The motor 40 can rotationally drive the drum 28 including that the motor 40 can rotate the drum 28 at various speeds in either rotational direction. The motor 40 can be configured to rotatably drive the drum 28 in response to a motor control signal.

While not illustrated, it will be understood that the washing machine 10 can further include a liquid supply system for supplying water to the washing machine 10 for use in treating laundry during a cycle of operation. The tub 26 holds the wash liquid that is used in the cycle of operation of the washing machine 10. The liquid supply system can include a source of water, such as a household water supply, which can include separate valves for controlling the flow of hot and cold water, respectively. Water can be supplied through an inlet conduit directly to the tub 26 by controlling first and second diverter mechanisms, respectively. The diverter mechanisms can be a diverter valve having two outlets such that the diverter mechanisms may selectively direct a flow of liquid to one or both of two flow paths. Water from the household water supply can flow through the inlet conduit to the first diverter mechanism, which may direct the flow of liquid to a supply conduit. The second diverter mechanism on the supply conduit may direct the flow of liquid to a tub outlet conduit, which can be provided with a spray nozzle configured to spray the flow of liquid into the tub 26. In this manner, water from the household water supply can be supplied directly to the tub 26.

While not illustrated, for clarity purposes, the washing machine 10 can also be provided with a dispensing system for dispensing treating chemistry to the treating chamber 36 for use in treating the laundry according to a cycle of operation. The dispensing system can include a dispenser, which can be a single use dispenser, a bulk dispenser, or a combination of a single use and bulk dispenser. Regardless of the type of dispenser used, the dispenser can be configured to dispense a treating chemistry directly to the tub 26 or mixed with water from the liquid supply system through a dispensing outlet conduit. The dispensing outlet conduit can include a dispensing nozzle configured to dispense the treating chemistry into the tub 26 in a desired pattern and under a desired amount of pressure. For example, the dispensing nozzle can be configured to dispense a flow or stream of treating chemistry into the tub 26 by gravity, i.e. a non-pressurized stream. Water can be supplied to the dispenser from the supply conduit by directing the diverter mechanism to direct the flow of water to a dispensing supply conduit.

Non-limiting examples of treating chemistries that may be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The washing machine 10 can also include a recirculation and drain system for recirculating liquid within the laundry holding system and draining liquid from the washing machine 10, which is also not illustrated herein. Liquid supplied to the tub 26 through tub outlet conduit and/or the dispensing supply conduit typically enters a space between the tub 26 and the drum 28 and can flow by gravity to a sump formed in part by a lower portion of the tub 26. The sump can also be formed by a sump conduit that can fluidly couple the lower portion of the tub 26 to a pump. The pump can direct liquid to a drain conduit, which can drain the liquid from the washing machine 10, or to a recirculation conduit, which can terminate at a recirculation inlet. The recirculation inlet can direct the liquid from the recirculation conduit into the drum 28. The recirculation inlet can introduce the liquid into the drum 28 in any suitable manner, such as by spraying, dripping, or providing a steady flow of liquid. In this manner, liquid provided to the tub 26, with or without treating chemistry can be recirculated into the treating chamber 36 for treating the laundry within.

The liquid supply and/or recirculation and drain system can be provided with a heating system (also not illustrated) which can include one or more devices for heating laundry and/or liquid supplied to the tub 26, such as a steam generator and/or a sump heater. Liquid from the household water supply can be provided to the steam generator through the inlet conduit by controlling the first diverter mechanism to direct the flow of liquid to a steam supply conduit. Steam generated by the steam generator can be supplied to the tub 26 through a steam outlet conduit. The steam generator can be any suitable type of steam generator such as a flow through steam generator or a tank-type steam generator. Alternatively, the sump heater can be used to generate steam in place of or in addition to the steam generator. In addition or alternatively to generating steam, the steam generator and/or sump heater can be used to heat the laundry and/or liquid within the tub 26 as part of a cycle of operation.

Figure 2:
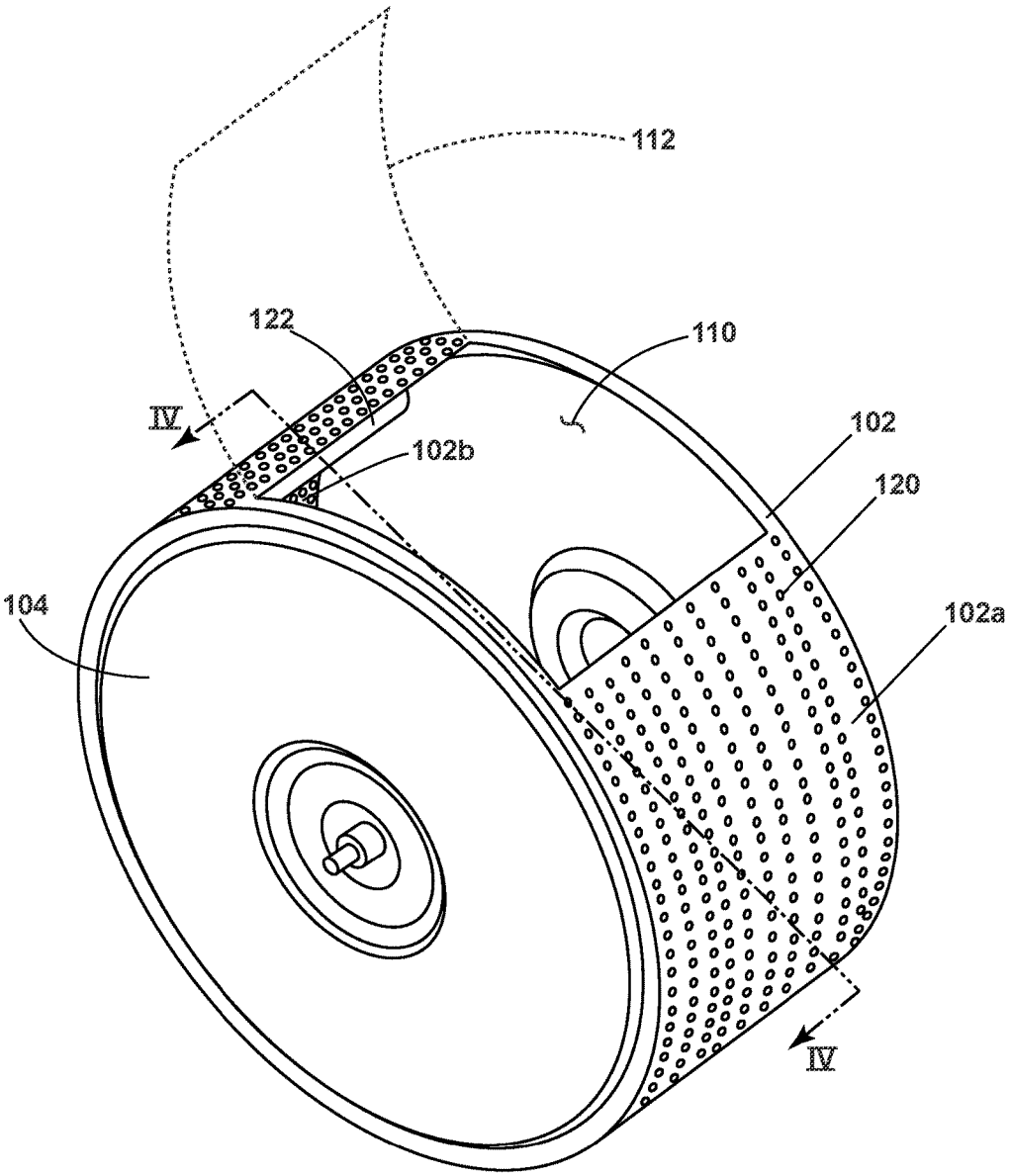
FIG. 2 is a perspective view of a drum of the washing machine in FIG. 1 without a flexible fabric wrapping.

FIG. 2 is a perspective view of the drum 28 removed from the washing machine 10 shown for better clarity without a flexible wrapping. The location of an openable door 112 that might ordinarily be found on a conventional drum is shown in dashed lines, for reference. The drum 28 can be a cylinder drum that comprises a stainless steel cylindrical shell 102 having an exterior surface 102*a*, an interior surface 102*b*, and end walls 104. Alternatively, the drum 28 can be formed of plastic, aluminum, steel coated with porcelain, or other suitable material. The shell 102 is provided with a drum opening 110. It will be understood that the drum opening 110 can have any suitable shape, profile, or contour including that it can be rectangular, square, etc. Opening 110 can optionally be surrounded with a frame (not shown). The frame can be operably coupled to the shell 102. The frame can include, but is not limited to, stainless steel, plastic, or any other material suitable to the drum 28. Regardless of its configuration the drum opening 110 is configured to allow access to the treating chamber 36 within the drum 28.

The drum 28 can include a plurality of perforations 120 such that liquid can flow between the tub 26 and the drum 28 through the perforations 120. A plurality of lifters 122 (FIG. 4) can be disposed on an inner surface of the drum 28 to lift the laundry load received in the treating chamber 36 while the drum 28 rotates. It is also within the scope of aspects of the present disclosure for the laundry holding system to comprise only a tub with the tub defining the laundry treating chamber.

Alternatively, an optional openable door can be operably coupled to the shell 102 to be opened and closed to provide access to the treating chamber 36 through opening 110. For reference, a location of such an optional openable door 112 is shown in dashed lines in FIG. 2. The optional openable door 112 can comprise one or more openable panels that can be hingedly, slidably, spring loaded, or otherwise disposed and configured to securely close and to open. When the optional openable door 112 is in the opened position, its opening 110 can be aligned with the opening 34, the opening 20, and the opened lid 14 to allow access into the drum 28 such that laundry can be loaded into and unloaded from the drum 28.

Figure 3:
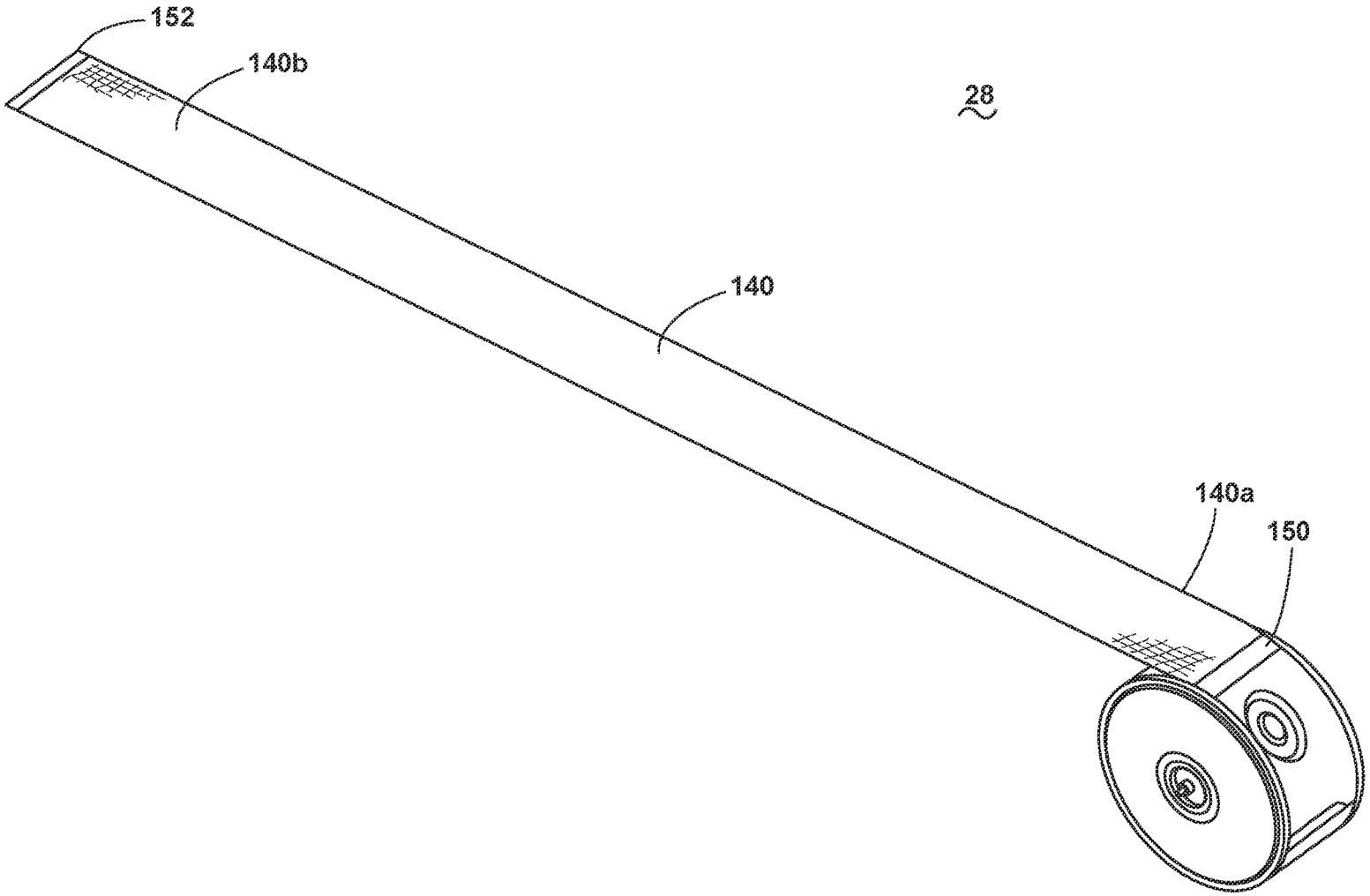
FIG. 3 is a perspective view of the drum of FIG. 2 with a flexible fabric wrapping extended according to aspects of the present disclosure.

It will be understood that drums according to the present disclosure do not need an optional openable door(s) of the hinged or sliding type. Regardless of whether a door is included, aspects of the present disclosure can employ a flexible fabric wrapping 140 disposed on the exterior surface 102*a* of the shell 102. Such a flexible wrapping 140 can be configured to wrap around and be in contactual relation to the exterior surface 102*a* of the shell 102. FIG. 3 illustrates an example of the extended flexible fabric wrapping 140 unwound from the drum 28 for clarity purposes. The wrapping 140 can be wrapped around and secured to the drum 28 with any suitable coupling configuration. By way of non-limiting example a first end 140*a* of the wrapping 140 can be secured to the drum 28 utilizing a tied contact (not shown). In one example, the tied contact can be a spring loaded pin 150 that can be fixed to the drum 28 at any position on the exterior surface 102*a* of shell 102. The first end 140*a* of the wrapping 140 can be fixed to the drum 28 by the pin 150 provided to exterior surface 102*a* of shell 102.

Alternatively, the pin 150 can be removably attached to the drum 28. In another non-limiting example, the wrapping 140 can be secured to the drum with a fastening means including but not limited to a riveting process or an upending process to secure the wrapping 140 at the first end 140*a*. The wrapping 140 can also be directly connected to the drum 28 through a series of smoothed openings (not shown) in the drum 28 that can comprise a smooth, curved surface to provide contact with the wrapping 140 to minimize stress on the wrapping 140. The wrapping 140 can have fingers at a first end 140*a* that can be fed through the smoothed openings of the drum 28 and then each finger can be returned back on itself to be sewed together, weaved together, or fastened together by any suitable method to complete the attachment of the wrapping 140 to the drum 28.

The wrapping 140 can be spring loaded and wrap around a take-up device 152 at a second end 140*b* of the wrapping 140. The take-up device 152 can comprise a spring loaded mechanism configured to take up the wrapping 140 as it is unwound from the drum 28. In essence the take-up device maintains tension on the wrapping 140 much like a spring in a tape measure. The take-up device 152 can be in a fixed location interior to the cabinet 12 or alternatively be configured to transfer between one or more locations interior to the cabinet 12 such as the drum 28, tub 26, and/or door 112 to provide user access to the drum 28 for the loading and unloading of laundry items.

Wrapping 140 can comprise any suitable flexible fabric, such as a para-aramid synthetic fiber with high tensile strength, which is not adversely affected by wash liquids and with a tensile strength high enough to withstand the forces placed upon the fabric while wrapped around the drum during a cycle of operation. Wrapping 140 can also comprise holes to allow liquid to pass through the fabric. The holes in the fabric can be innate to the fabric type used. Alternatively, the holes can be manually or machine formed and the holes can be oriented such that more holes are formed in the area away from the drum opening 110.

Wrapping 140 can lie flat in contactual relation to the exterior surface 102*a* of shell 102 under manually or mechanically applied tension or in any configuration to most effectively keep the wrapping 140 in place as it is wound around the drum 28. The side edges of the wrapping 140 can be rolled onto itself, much like a hem, to help reduce the deflection of the wrapping 140 over the drum opening 110 in the axial direction of the drum 28. This can also help prevent deformation, such as twisting and/or contorting, of the wrapping 140 in the axial direction along the sides of the drum 28 as the drum 28 is wrapped or as the drum 28 spins during an operational cycle. Alternatively, the side edges of the wrapping 140 can be textured. Additionally, pre-load tension can be placed on the wrapping 140 in the axial and/or circumferential direction prior to wrapping the drum 28 to prevent wrinkles in the wrapping 140 and equalize the frictional forces between the layers.

Figure 4:
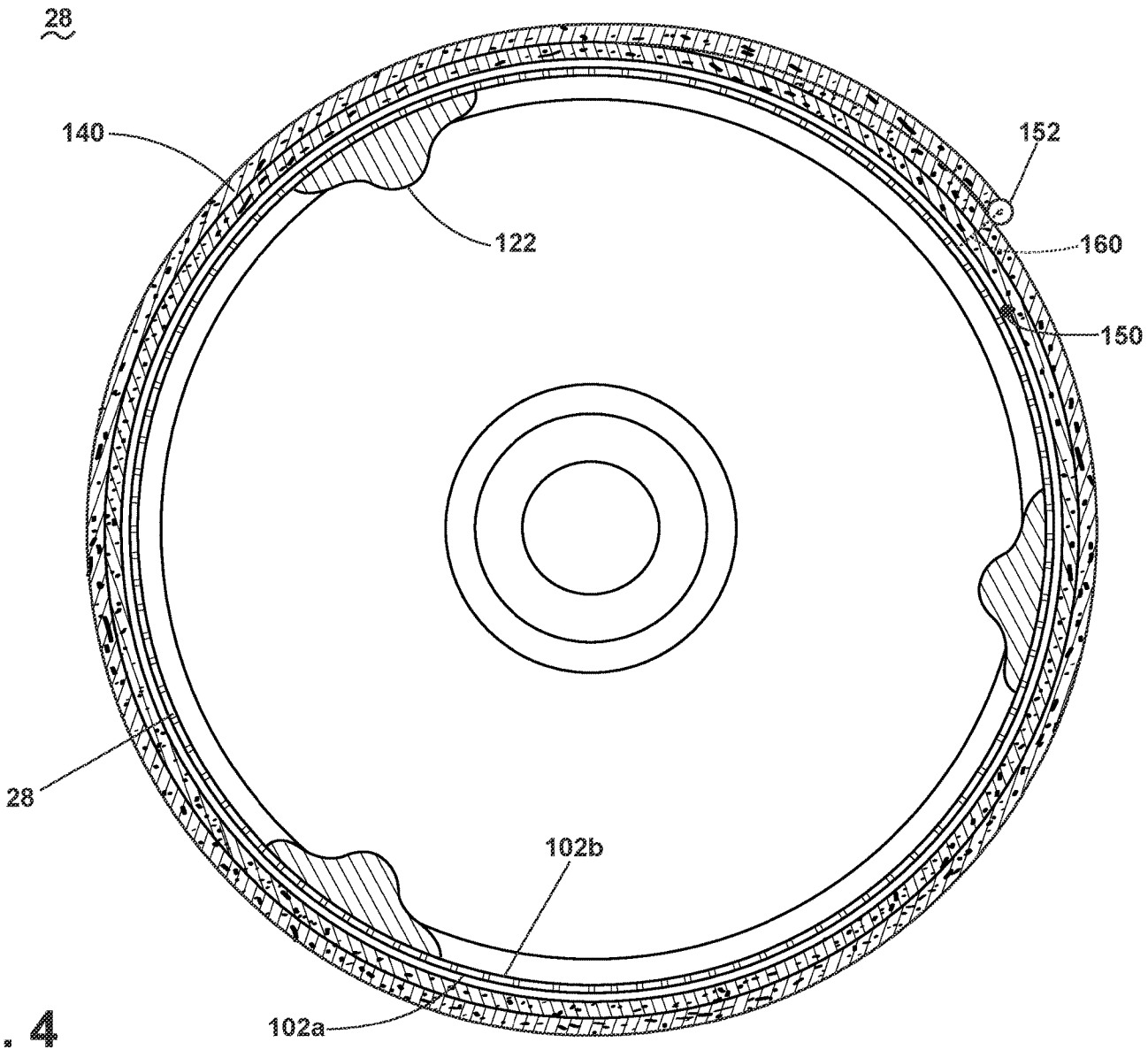
FIG. 4 is a side cross-sectional view of the drum of FIG. 2 wrapped with the flexible fabric wrapping of FIG. 3 according to aspects of the present disclosure.

FIG. 4 is a schematic side cross-sectional view of the drum of FIG. 2 along the line IV-IV with the flexible fabric wrapping 140 wrapped around the drum 28 according to aspects of the present disclosure. Wrapping 140 can be wrapped around the drum 28 to provide two or more layers of flexible fabric across the drum opening 110 in order to contain laundry items in the treating chamber 36 during operation of the laundry treating appliance without damage to the laundry items. Additionally, applicants have found two or more layers of flexible fabric wrapping 140 decrease the load on pin 150 during the cycles of operation. Take-up device 152 can be removably secured to the drum 28 by a securing mechanism 160. Securing mechanism 160 can be any of any suitable in which to secure take-up device 152 in place while the wrapping 140 is wrapped around drum 28 and/or the drum 28 is in motion.

In an exemplary aspect of the present disclosure, referring to FIG. 3 and FIG. 4, the first end 140*a* of the wrapping 140 can be secured to drum 28 by the pin 150 which can be fixedly attached to drum 28 on the exterior surface 102*a* of the shell 102. The wrapping 140 can then be pre-loaded with axial and circumferential tension and subsequently or simultaneously wrapped around the drum 28 one or more times. By way of non-limiting example, the wrapping 140 can be placed under an axial preload of 0.05 N/mm width and a circumferential preload of 0.8 N/mm width and wrapped around the drum 28 in 0.5 seconds under this constant preload force to provide at least two layers of the wrapping 140 to cover the opening 110. Following wrapping the drum 28, the take-up device 152 can be removably secured to the drum 28. The washing machine 10 can then run any operational cycle or series of cycles pre-programmed or selected by a user.

The wrapping 140 can be wrapped around the exterior surface 102*a* of the drum 28 by any manual and/or mechanical means to provide the fabric wrapping 140 to cover the opening 110 to contain the laundry in the drum 28 while minimizing the damage to the laundry during a wash and/or extraction phase. Prior to beginning an automatic cycle of operation, a user can open the lid 14 and place a load of laundry into the drum 28. The user can manually turn the drum 28 in order to wrap the wrapping 140 around the drum. Alternatively, the user can make a selection from the operating controls 23 to signal the wrapping 140 and/or the drum 28 to close the access to the drum by initiating the drum 28 to spin and the wrapping 140 to wrap around the exterior surface 102*a* of the shell 102. The securing mechanism 160 can secure the take-up device 152 to the drum 28 when the drum 28 is wound with the wrapping 140. Additionally, the securing mechanism 160 can secure the take-up device 152 to any of the tub 26, door 112, lid 14, and/or any suitable space interior to cabinet 12 when the wrapping 140 is unwound from the drum. The securing mechanism 160 can be configured to be locked and unlocked manually or automatically by a signal from the control system 22. Additionally, a user can select a cycle of operation in which the first step can be to wrap the drum 28 with the wrapping 140.

Once wrapped around the drum 28, the wrapping 140 can be unwrapped to provide user access to the drum 28 opening 110 for unloading and unloading of laundry items by the control system or manually by the user. The final step of a cycle of operation selected by a user can include unwrapping the wrapping 140 from the drum 28 to provide access to the opening 110 by automatic and mechanical means. Additionally, at the completion of a cycle of operation, a user can manually unwrap the wrapping 140 from the drum 28 by manually turning the drum 28 to provide access to the opening 110. The take-up device 152 can be detached from the drum 28 by the release of the securing mechanism 160 and the take-up device 152 can be removably secured with the securing mechanism 160 to any of the tub 26, door 112, lid 14, and/or any suitable space interior to cabinet 12 manually by a user or automatically by the control system at the end of a cycle of operation. The take-up device 152 can be rotated to roll the wrapping 140 onto the take-up device 152 as the drum 28 slowly rotates to unwrap the wrapping 140 from the drum 28 and provide access to the opening 110. Once the laundry items are loaded or unloaded by the user, the drum 28 can be rotated and the wrapping 140 can be wrapped around the exterior surface 102*a* of the drum 28 under a preload force suitable to maintain proper alignment of the wrapping 140 around the drum 28.

To the extent not already described, the different features and structures of the various embodiments can be used in combination with each other as desired. That one feature cannot be illustrated in all of the embodiments is not meant to be construed that it cannot be, but is done for brevity of description. Thus, the various features of the different embodiments can be mixed and matched as desired to form new embodiments, whether or not the new embodiments are expressly described. Combinations or permutations of features described herein are covered by this disclosure.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A laundry treating appliance for treating a load of laundry according to a cycle of operation, the laundry treating appliance comprising:

a cabinet defining an interior;

a tub, housed within the interior;

a drum at least partially received within the tub, the drum having a sidewall and a pair of end walls and defining a circumference of the drum and at least partially defining a treating chamber and having a drum opening disposed within the sidewall and the drum is configured to selectively rotate within the tub; the sidewall comprising a shell defining an exterior surface with the drum opening located in the shell;

a moveable door operably coupled to the shell and moveable between an opened position wherein access is provided to the treating chamber through the drum opening and a closed position; and a flexible fabric material operably coupled at a first end to a portion of the drum and configured to wrap, under tension, to cover the circumference of the sidewall including the drum opening.

2. The laundry treating appliance of claim 1 wherein the flexible fabric material is configured to move between an unwrapped position and a wrapped position wherein at least a length of the flexible fabric material is wrapped around and in contact with the exterior surface of the shell.

3. The laundry treating appliance of claim 1, further comprising a pin operably coupled to the drum and configured to secure the flexible fabric material in the wrapped position.

4. The laundry treating appliance of claim 2 wherein the length of the flexible fabric material is configured to be wound about an entire circumference of the drum and overlap to provide at least two layers of the flexible fabric material across the drum opening in the wrapped position.

5. The laundry treating appliance of claim 2, further comprising a take-up device comprising a spring-loaded mechanism, the take-up device configured to take up the flexible fabric material from the drum as it moves from the wrapped position to the unwrapped position.

6. The laundry treating appliance of claim 2, further comprising a motor operably coupled to the drum to rotate the drum in response to a signal from a controller and wherein the controller is configured to automatically operate the motor to move the flexible fabric material to the wrapped position.

7. The laundry treating appliance of claim 1, wherein the flexible fabric material includes openings to allow liquid to pass through the flexible fabric material.

8. A laundry treating appliance for treating a load of laundry according to a cycle of operation, the laundry treating appliance comprising:

a cabinet defining an interior;

a tub, housed within the interior;

a drum at least partially received within the tub, the drum having a sidewall defining a circumference of the drum and at least partially defining a treating chamber and having a drum opening disposed within the sidewall and the drum is configured to selectively rotate within the tub; the sidewall comprising a shell defining an exterior surface with the drum opening located in the shell; and a flexible fabric material operably coupled at a first end to a portion of the drum and configured to move between an unwrapped position and a wrapped position wherein at least a length of the flexible fabric material is configured to be wound about an entire circumference of the drum and overlap to provide at least two layers of the flexible fabric material across the drum opening in the wrapped position.

9. The laundry treating appliance of claim 8 wherein the shell is cylindrical and enclosed by a pair of end walls.

10. The laundry treating appliance of claim 8, further comprising a moveable door operably coupled to the shell and moveable between an opened position wherein access is provided to the treating chamber through the drum opening and a closed position.

11. The laundry treating appliance of claim 8, further comprising a pin operably coupled to the drum and configured to secure the flexible fabric material in the wrapped position.

12. The laundry treating appliance of claim 8, further comprising a take-up device comprising a spring-loaded mechanism, the take-up device configured to take up the flexible fabric material from the drum as it moves from the wrapped position to the unwrapped position.

13. The laundry treating appliance of claim 8, further comprising a motor operably coupled to the drum to rotate the drum in response to a signal from a controller and wherein the controller is configured to automatically operate the motor to move the flexible fabric material to the wrapped position.

14. The laundry treating appliance of claim 8, wherein the flexible fabric material includes openings to allow liquid to pass through the flexible fabric material.

15. A laundry treating appliance for treating a load of laundry according to a cycle of operation, the laundry treating appliance comprising:

a cabinet defining an interior;

a tub, housed within the interior;

a drum at least partially received within the tub, the drum having a sidewall defining a circumference of the drum and at least partially defining a treating chamber and having a drum opening disposed within the sidewall and the drum is configured to selectively rotate within the tub; the sidewall comprising a shell defining an exterior surface with the drum opening located in the shell;

a flexible fabric material operably coupled at a first end to a portion of the drum and configured to move between an unwrapped position and a wrapped position wherein at least a length of the flexible fabric material is configured to be wound about an entire circumference of the drum; and a take-up device comprising a spring-loaded mechanism, the take-up device configured to take up the flexible fabric material from the drum as it moves from the wrapped position to the unwrapped position.

16. The laundry treating appliance of claim 15 wherein the shell is cylindrical and enclosed by a pair of end walls.

17. The laundry treating appliance of claim 16, further comprising a moveable door operably coupled to the shell and moveable between an opened position wherein access is provided to the treating chamber through the drum opening and a closed position.

18. The laundry treating appliance of claim 15 wherein the flexible fabric material is configured to move between an unwrapped position and a wrapped position wherein at least a length of the flexible fabric material is wrapped around and in contact with the exterior surface of the shell.

19. The laundry treating appliance of claim 15, further comprising a pin operably coupled to the drum and configured to secure the flexible fabric material in the wrapped position.

20. The laundry treating appliance of claim 19 wherein the length of the flexible fabric material is configured to be wound about an entire circumference of the drum and overlap to provide at least two layers of the flexible fabric material across the drum opening in the wrapped position.

21. The laundry treating appliance of claim 15, further comprising a motor operably coupled to the drum to rotate the drum in response to a signal from a controller and wherein the controller is configured to automatically operate the motor to move the flexible fabric material to the wrapped position.

22. The laundry treating appliance of claim 15, wherein the flexible fabric material includes openings to allow liquid to pass through the flexible fabric material.

* * * * *